US011749172B2

(12) United States Patent
Kim et al.

(10) Patent No.: US 11,749,172 B2
(45) **Date of Patent: *Sep. 5, 2023**

(54) DISPLAY APPARATUS AND METHOD OF DRIVING ATYPICAL DISPLAY PANEL USING THE SAME

(71) Applicant: SAMSUNG DISPLAY CO., LTD., Yongin-si (KR)

(72) Inventors: Taejin Kim, Bucheon-si (KR); Jakyoung Jin, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/809,200

(22) Filed: Jun. 27, 2022

(65) Prior Publication Data

US 2022/0327990 A1 Oct. 13, 2022

Related U.S. Application Data

(63) Continuation of application No. 17/101,954, filed on Nov. 23, 2020, now Pat. No. 11,373,580, which is a (Continued)

(30) Foreign Application Priority Data

Mar. 9, 2018 (KR) ..... 10-2018-0028269

(51) Int. Cl.
*G09G 3/20* (2006.01)
*G09G 5/14* (2006.01)

(52) U.S. Cl.
CPC ..... *G09G 3/2096* (2013.01); *G09G 5/14* (2013.01); *G09G 2310/02* (2013.01); (Continued)

(58) Field of Classification Search
CPC .... G09G 3/2096; G09G 5/14; G09G 2310/02; G09G 2310/0243; G09G 2310/0267; (Continued)

(56) References Cited

U.S. PATENT DOCUMENTS 7,136,040 B1 11/2006 Park et al.
7,652,650 B2 1/2010 Takagi et al.
(Continued)

FOREIGN PATENT DOCUMENTS

JP 2009-069768 4/2009
KR 10-0599470 7/2006
(Continued)

*Primary Examiner* — Sahlu Okebato
(74) *Attorney, Agent, or Firm* — F. CHAU & ASSOCIATES, LLC

(57) ABSTRACT

A display apparatus includes a display panel configured to display an image. A gate driver is configured to output a plurality of gate signals to the display panel. A data driver includes a first area and a second area. The first area of the data driver includes a first channel group configured to output first data voltages in a first output sequence. The second area of the data driver includes a second channel group configured to output second data voltages in a second output sequence opposite to the first output sequence.

22 Claims, 8 Drawing Sheets

Related U.S. Application Data continuation of application No. 16/298,005, filed on Mar. 11, 2019, now Pat. No. 10,847,080.

(52) U.S. Cl.
CPC ..... *G09G 2310/0243* (2013.01); *G09G 2310/0267* (2013.01); *G09G 2310/0275* (2013.01); *G09G 2310/0281* (2013.01); *G09G 2310/0283* (2013.01); *G09G 2330/028* (2013.01)

(58) Field of Classification Search
CPC ... G09G 2310/0275; G09G 2310/0281; G09G 2310/0283; G09G 2330/028
See application file for complete search history.

(56) References Cited

U.S. PATENT DOCUMENTS

| | | | | |
|---|---|---|---|---|
| 10,847,080 | B2 | 11/2020 | Kim et al. | |
| 2005/0248556 | A1 | 11/2005 | Yoshinaga et al. | |
| 2006/0227071 | A1 | 10/2006 | Han | |
| 2006/0233003 | A1 | 10/2006 | Iwanaga et al. | |
| 2012/0076263 | A1 | 3/2012 | Tso et al. | |
| 2015/0138041 | A1 | 5/2015 | Hirakata et al. | |
| 2015/0161928 | A1* | 6/2015 | Kim | G09G 3/3225 345/1.3 |
| 2015/0356898 | A1 | 12/2015 | Jeon et al. | |
| 2016/0322008 | A1* | 11/2016 | Sang | G09G 3/3607 |
| 2017/0148374 | A1* | 5/2017 | Lee | G09G 5/14 |
| 2019/0206308 | A1* | 7/2019 | Yoo | G09G 3/20 |
| 2019/0279556 | A1 | 9/2019 | Kim et al. | |
| 2021/0074202 | A1 | 3/2021 | Kim et al. | |

FOREIGN PATENT DOCUMENTS

| | | |
|---|---|---|
| KR | 10-0721944 | 5/2007 |
| KR | 10-2017-0129748 | 11/2017 |

* cited by examiner

DISPLAY APPARATUS AND METHOD OF DRIVING ATYPICAL DISPLAY PANEL USING THE SAME

PRIORITY STATEMENT

This Application is a Continuation of co-pending U.S. patent application Ser. No. 17/101,954, filed on Nov. 23, 2020, which is a Continuation of U.S. patent application Ser. No. 16/298,005, filed on Mar. 11, 2019, which claims priority under 35 U.S.C. § 119 to Korean Patent Application No. 10-2018-0028269, filed on Mar. 9, 2018 in the Korean Intellectual Property Office KIPO, the contents of which are herein incorporated by reference in their entireties.

TECHNICAL FIELD

The present disclosure relates to a display apparatus and, more particularly, to a display apparatus and a method of driving an atypical display panel using the display apparatus.

DISCUSSION OF THE RELATED ART

Generally, a display apparatus includes a display panel and a display panel driver for driving the display panel. Most commonly, display panels have a rectangular shape or a chamfered rectangular shape such as a shape of a rectangle with rounded corners.

Display panels having a shape that is not substantially rectangular may be referred to herein as having an atypical shape or being atypical. Such display panels may have an arbitrary shape such as that of an irregular polygon or a circle-like shape.

Display panels are generally driven by a matrix of orthogonal gate lines and data lines. When the display panel has an atypical shape and the display panel is driven by a conventional method of driving the display panel, the display quality of the display panel may be deteriorated and dead space in which no image is displayable may increase.

SUMMARY

A display apparatus includes a display panel configured to display an image. A gate driver is configured to output a plurality of gate signals to the display panel. A data driver includes a first area and a second area. The first area of the data driver includes a first channel group configured to output first data voltages in a first output sequence. The second area of the data driver includes a second channel group configured to output second data voltages in a second output sequence opposite to the first output sequence.

A method of driving a display panel includes outputting a plurality of gate signals to the display panel. A first plurality of data voltages is output to a first display area of the display panel in a first output sequence using a first channel group of a data driver. A second plurality of data voltages is output to a second display area of the display panel in a second output sequence, opposite to the first output sequence, using a second channel group of the data driver.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION OF THE INVENTIVE CONCEPT

Figure 1:
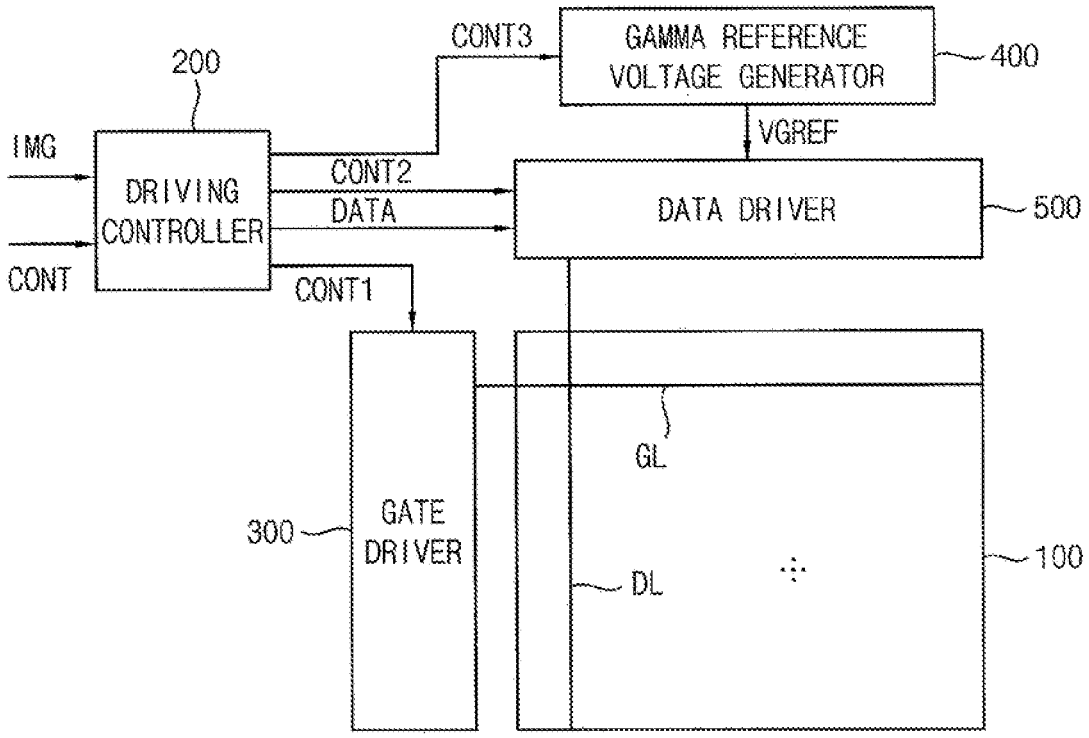
FIG. 1 is a block diagram illustrating a display apparatus according to an exemplary embodiment of the present inventive concept.

In describing exemplary embodiments of the present disclosure illustrated in the drawings, specific terminology is employed for sake of clarity. However, the present disclosure is not intended to be limited to the specific terminology so selected, and it is to be understood that each specific element includes all technical equivalents which operate in a similar manner.

Hereinafter, the present inventive concept will be explained in detail with reference to the accompanying drawings.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400, and a data driver 500.

The display panel 100 has a display region in which an image is displayed and a peripheral region adjacent to the display region in which no image is displayed.

The display panel 100 includes a plurality of gate lines GL, a plurality of data lines DL and a plurality of pixels connected to the gate lines GL and the data lines DL. The gate lines GL and the data lines DL extend in directions crossing each other, for example, perpendicularly.

The driving controller 200 receives input image data IMG and an input control signal CONT from an external apparatus. The input image data may include red image data, green image data, and blue image data. The input image data may additionally include white image data. The input image data may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 sequentially outputs the gate signals to the gate lines GL.

According to exemplary embodiments of the present disclosure, the gate driver 300 may be a gate driving circuit integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment of the present disclosure, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into analog data voltages based on the gamma reference voltages VGREF. The data driver 500 outputs the data voltages to the data lines DL.

According to exemplary embodiments of the present disclosure, the driving controller 200 and the data driver 500 may be formed as a single chip.

Figure 2:
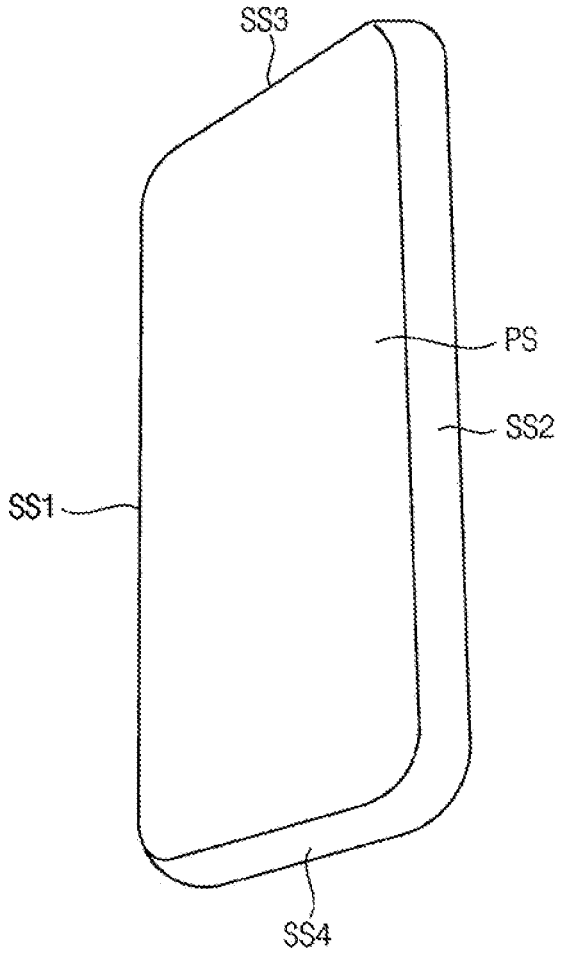
FIG. 2 is a perspective view illustrating the display apparatus of FIG. 1.
Figure 3:
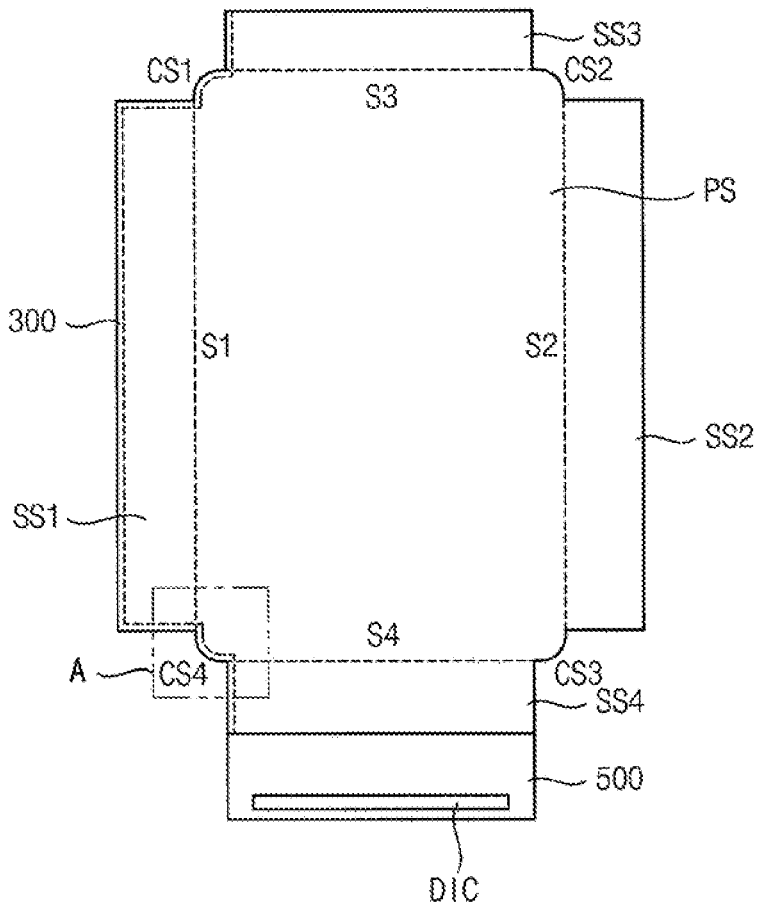
FIG. 3 is a plan view illustrating a display panel of FIG. 2.
Figure 4:
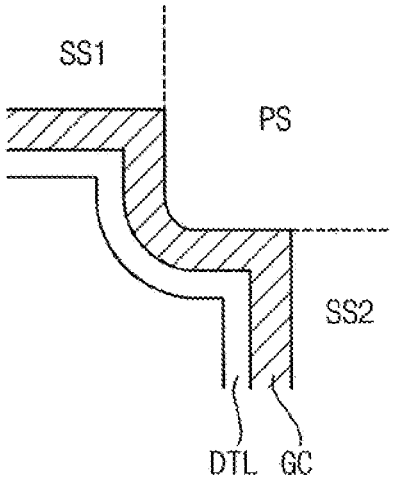
FIG. 4 is a plan view illustrating an area A of FIG. 3.

FIG. 2 is a perspective view illustrating the display apparatus of FIG. 1. FIG. 3 is a plan view illustrating the display panel 100 of FIG. 2. FIG. 4 is a plan view illustrating an area A of FIG. 3.

Referring to FIGS. 1 to 4, the display panel 100 may include an upper surface PS, a first side surface SS1 extending externally from a first side S1 of the upper surface PS, a second side surface SS2 extending externally from a second side S2 of the upper surface PS, and a third side surface SS3 extending externally from a third side S3 of the upper surface PS connecting the first side S1 and the second side S2.

For example, the upper surface PS, the first side surface SS1, the second side surface SS2, and the third side surface SS3 may display the image. The upper surface PS, the first side surface SS1, the second side surface SS2, and the third side surface SS3 may display a single continuous image. Alternatively, the upper surface PS, the first side surface SS1, the second side surface SS2, and the third side surface SS3 may each display an independent image. The first side surface SS1, the second side surface SS2 and the third side surface SS3 may display software-enabled functional keys, widgets, menu bars, and so on.

For example, the display panel 100 might not extend externally from a fourth side S4 of the upper surface PS facing the third side S3. Thus, an externally extending portion (an area referred to SS4) from the fourth side S4 of the upper surface PS might not display the image. In the portion SS4, a battery charger connection jack (e.g. "charging port") or an earphone connection jack of the display apparatus may be disposed.

In this case, the data driver 500 may be disposed adjacent to the fourth side S4 of the upper surface PS.

Alternatively, the display panel 100 may further include a fourth side surface SS4 extending externally from the fourth side S4 of the upper surface PS facing the third side S3. The upper surface PS, the first side surface SS1, the second side surface SS2, the third side surface SS3 and the fourth side surface SS4 may display the image.

In this case, the data driver 500 may be disposed adjacent to the fourth side surface SS4.

The data driver 500 may include a data driving chip DIC. For example, the data driving chip DIC and the driving controller 200 may form a single integrated chip.

The upper surface PS of the display panel 100 may further include a first curved side CS1 connecting the first side S1 and the third side S3, a second curved side CS2 connecting the third side S3 and the second side S2, a third curved side CS3 connecting the second side S2 and the fourth side S4, and a fourth curved side CS4 connecting the fourth side S4 and the first side S1.

The gate driver 300 may be integrated on the display panel 100. The gate driver 300 may be disposed at a side of the display panel 100 and may output the gate signal in a horizontal direction.

For example, the gate driver 300 may be disposed along a first side of the third side surface SS3 and a first side of the first side surface SS1. For example, the gate driver 300 may be disposed along a left side of the third side surface SS3, the first curved side CS1 of the upper surface PS, a left side of the first side surface SS1, the fourth curved side CS4 of the upper surface PS, and a left side of the fourth side surface SS4.

As shown in FIG. 4, a gate driving circuit GC of the gate driver 300 may be disposed along the fourth curved side CS4 of the upper surface PS and a data transmitting line DTL may be disposed along the fourth curved side CS4 of the upper surface PS to transmit the data voltage to the first side surface SS1 in the area A.

When the gate driving circuit GC and the data transmitting line DTL are disposed along the fourth curved side CS4 of the upper surface PS, a dead space of the upper surface PS of the display panel 100 may increase. The gate driving circuit GC is disposed along the fourth curved side CS4 but the data transmitting line may be formed at an active area of the upper surface PS so that the dead space may be reduced by the area of the data transmitting line. The above mentioned structure of the data transmitting line is further explained with reference to FIGS. 5 to 7.

Figure 5:
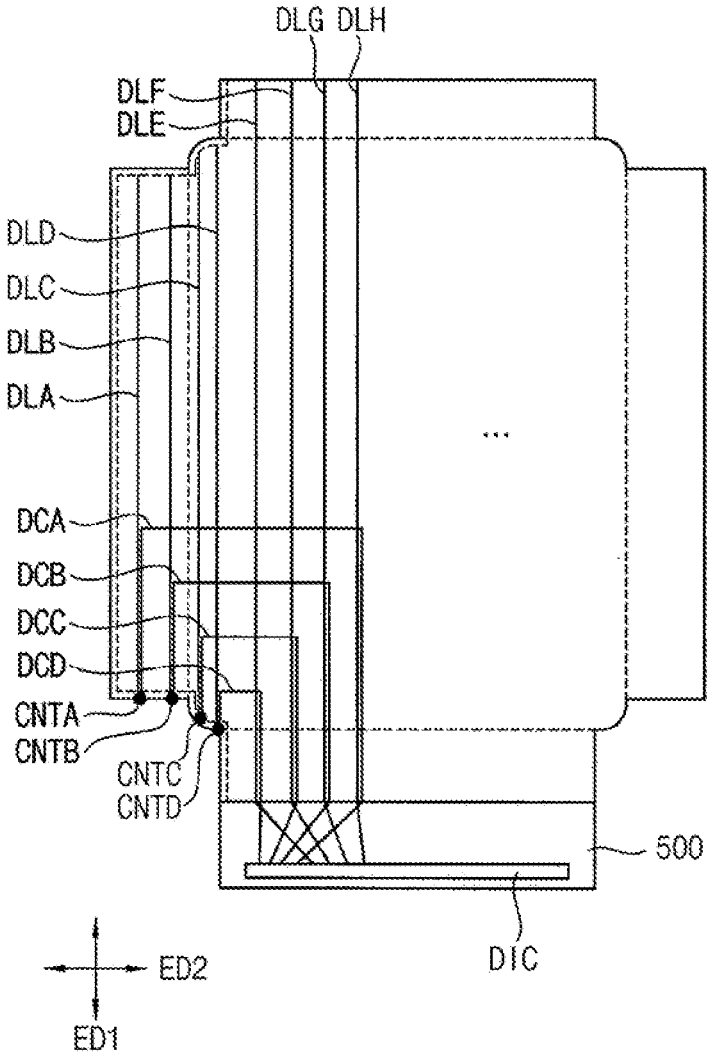
FIG. 5 is a conceptual diagram illustrating a method of driving data lines of the display panel of FIG. 3.
Figure 6:
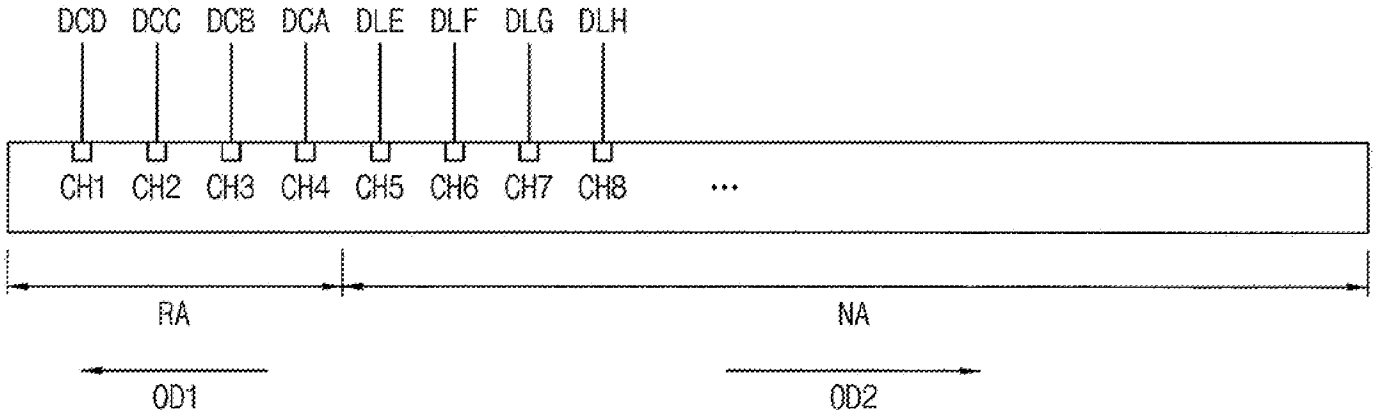
FIG. 6 is a conceptual diagram illustrating a data driver of FIG. 3.
Figure 7:
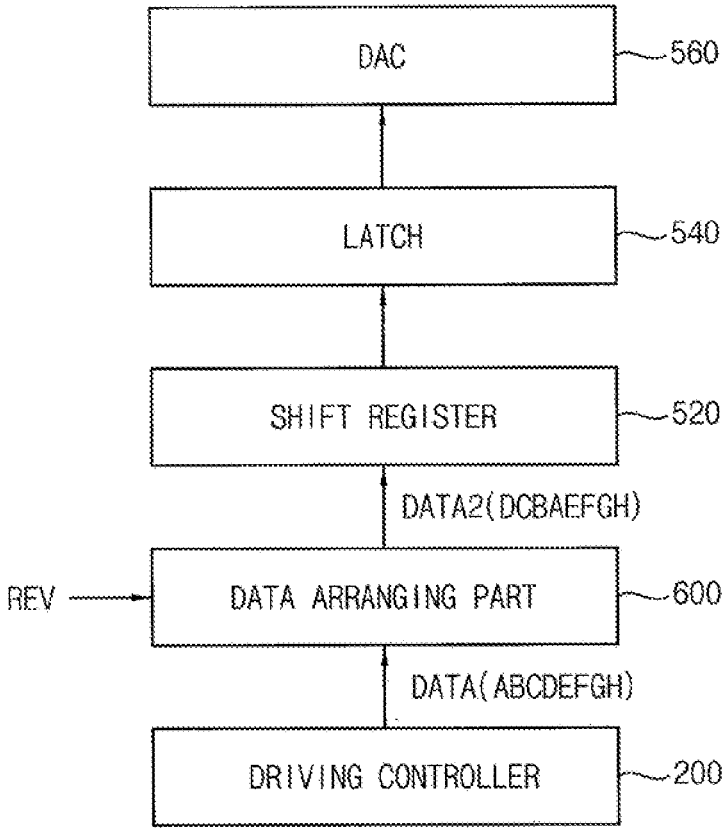
FIG. 7 is a block diagram illustrating a driving controller of FIG. 1, the data driver of FIG. 3 and a data arranging part.

FIG. 5 is a conceptual diagram illustrating a method of driving data lines of the display panel 100 of FIG. 3. FIG. 6 is a conceptual diagram illustrating the data driver 500 of FIG. 3. FIG. 7 is a block diagram illustrating a driving controller of FIG. 1, the data driver 500 of FIG. 3, and a data arranging part 600.

Referring to FIGS. 1 to 7, the first side surface SS1 and the upper surface PS display the image so that the data lines are disposed in the first side surface SS1 and the upper surface PS.

In FIG. 5, a first data line DLA and a second data line DLB are each disposed in the first side surface SS1. A third data line DLC and a fourth data line DLD are each disposed between the first curved side CS1 and the fourth curved side CS4 of the upper surface PS. Fifth to eighth data lines DLE, DLF, DLG, and DLH are each disposed between the third side S3 and the fourth side S4 of the upper surface PS. The fifth to eighth data lines DLE, DLF, DLG, and DLH may each extend to the third side surface SS3 and the fourth side surface SS4. The first to eighth data lines DLA to DLH may each extend along a first extending direction ED1.

Although eight data lines are illustrated in FIG. 5 for convenience of explanation, the display panel 100 may include more than eight data lines. For example, more than two data lines may be disposed in the first side surface SS1, more than two data lines may be disposed between the first curved side CS1 and the fourth curved side CS4, and more than four data lines may be disposed between the third side S3 and the fourth side S4. The number of the data lines on the display panel 100 may correspond to the number of pixel columns of the display panel 100. Thus, the second data line DLB might not be adjacent to the first data line DLA. The third data line DLC might not be adjacent to the second data line DLB. The fourth data line DLD might not be adjacent to third data line DLC. The fifth data line DLE might not be adjacent to the fourth data line DLD. The sixth data line DLF might not be adjacent to the fifth data line DLE.

To omit the data transmitting line area DTL of the area A of FIG. 4, the display panel 100 may include first to fourth connecting lines DCA to DCD connecting the first to fourth data lines DLA to DLD to channels of the data driver 500.

The first data line DLA is connected to a corresponding channel of the data driver 500 through the first connecting line DCA. The first connecting line DCA crosses other data lines (e.g. DLH, DLG, DLF, DLE, DLD, DLC, and DLB) so that the first data line DLA and the first connecting line DCA may be disposed on different planes. The first data line DLA and the first connecting line DCA may be connected to each other through a first contact hole CNTA.

The first connecting line DCA may include a first connecting portion extending in the first extending direction ED1 and connected to the channel, a second connecting portion extending in a second extending direction ED2 crossing the first extending direction ED1, and a third connecting portion extending from the second connecting portion in the first extending direction ED1 and overlapped with the first contact hole CNTA.

The second data line DLB is connected to a corresponding channel of the data driver 500 through the second connecting line DCB. The second connecting line DCB crosses other data lines (e.g. DLG, DLF, DLE, DLD, and DLC) so that the second data line DLB and the second connecting line DCB may be disposed on different planes. The second data line DLB and the second connecting line DCB may be connected to each other through a second contact hole CNTB.

The second connecting line DCB may have a shape similar to that of the first connecting line DCA. A first connecting portion, a second connecting portion and a third connecting portion of the second connecting line DCB may be surrounded by the first connecting portion, the second connecting portion and the third connecting portion of the first connecting line DCA.

The third data line DLC is connected to a corresponding channel of the data driver 500 through the third connecting line DCC. The third connecting line DCC crosses other data lines (e.g. DLF, DLE, and DLD) such that the third data line DLC and the third connecting line DCC may be disposed on different planes. The third data line DLC and the third connecting line DCC may be connected to each other through a third contact hole CNTC.

The third connecting line DCC may have a shape similar to that of the second connecting line DCB. A first connecting portion, a second connecting portion, and a third connecting portion of the third connecting line DCC may be surrounded by the first connecting portion, the second connecting portion, and the third connecting portion of the second connecting line DCB.

The fourth data line DLD is connected to a corresponding channel of the data driver 500 through the fourth connecting line DCD. The fourth connecting line DCD crosses another data line (e.g. DLE) such that the fourth data line DLD and the fourth connecting line DCD may be disposed on different planes. The fourth data line DLD and the fourth connecting line DCD may be connected to each other through a fourth contact hole CNTD.

The fourth connecting line DCD may have a shape similar to that of the third connecting line DCC. A first connecting portion, a second connecting portion, and a third connecting portion of the fourth connecting line DCD may be surrounded by the first connecting portion, the second connecting portion, and the third connecting portion of the third connecting line DCC.

The first to eighth data lines DLA to DLH may be disposed on the same plane as each other. The first to fourth connecting lines DCA to DCD may be disposed on the same plane as each other.

The data driver 500 may include a first area RA and a second area NA. The first area RA includes a first channel group CH1 to CH4 outputting data voltages in a first output sequence OD1. The second area NA includes a second channel group CH5 to CH8 outputting data voltages in a second output sequence OD2 opposite to the first output sequence OD1. Herein, the output sequence means an outputting direction of image data from a pixel disposed at a first side of the display panel 100 to a pixel disposed at a second side of the display panel 100.

The first area RA is a reverse area outputting the data voltage corresponding to a reversed image in a horizontal direction with respect to the input image data. The second area NA is a normal area outputting the data voltage corresponding to the input image data. The first area RA may be formed at an end portion of the data driver 500.

For example, the first area RA may output the data voltage to the first side surface SS1 of the display panel 100. For example, the second area NA may output the data voltage to the upper surface PS of the display panel 100. The second area NA may output the data voltage to the upper surface PS, the third side surface SS3, and the fourth side surface SS4. In addition, a right end portion of the second area NA may output the data voltage to the second side surface SS2.

According to the connection structure of FIG. 5, a first channel CH1 outputs the data voltage to the fourth connecting line DCD which is connected to the fourth data line DLD. A second channel CH2 outputs the data voltage to the third connecting line DCC which is connected to the third data line DLC. A third channel CH3 outputs the data voltage to the second connecting line DCB which is connected to the second data line DLB. A fourth channel CH4 outputs the data voltage to the first connecting line DCA which is connected to the first data line DLA. A sequence of the first to fourth channels CH1 to CH4 may be reversed with respect to a sequence of the data lines DLD to DLA connected to the first to fourth channels CH1 to CH4 in the first area RA.

The fifth to eighth channels CH5 to CH8 respectively output the data voltages DLE to DLH. A sequence of the fifth to eighth channels CH5 to CH8 may be same as a sequence of the data lines DLE to DLH connected to the fifth to eighth channels CH5 to CH8 so that the output sequence of the second area RA might not be reversed with respect to the input image data.

Accordingly, the reverse driving method is applied to the first side surface SS1.

The display apparatus may further include the data arranging part 600 configured to reverse the output sequence of the first area RA.

The data arranging part 600 may reverse a sequence of a portion of the input data signal DATA based on a reverse signal REV to generate a reverse data signal DATA2. The sequence of the input data signal DATA may be A-B-C-D-E-F-G-H corresponding to the first, second, third, fourth, fifth, sixth, seventh, and eighth data lines DLA, DLB, DLC, DLD, DLE, DLF, DLG, and DLH. The sequence of the reverse data signal DATA2 may be D-C-B-A-E-F-G-H corresponding to the fourth, third, second, first, fifth, sixth, seventh, and eighth data lines DLD, DLC, DLB, DLA, DLE, DLF, DLG, and DLH.

The reverse signal REV may include a reverse start channel signal indicating a start point of the reverse driving, a reverse end channel signal indicating an end point of the reverse driving and a reverse enable signal enabling or disabling the reverse driving.

For example, the start point of the reverse driving may be a first channel CH1 and the end point of the reverse driving may be a fourth channel CH4.

When the reverse enable signal is in an active state, the data arranging part 600 may reverse the output sequence of a portion of the input data signal DATA. In contrast, when the reverse enable signal is in an inactive state, the data arranging part 600 may maintain the output sequence of the input data signal DATA.

The data arranging part 600 may be disposed between the driving controller 200 and a shift register 520 of the data driver 500. In an exemplary embodiment of the present disclosure, the data arranging part 600 and the data driver 500 may be integrally formed. Alternatively, the data arranging part 600 and the timing controller 200 may be integrally formed. Alternatively, the timing controller 200, the data arranging part 600, and the data driver 500 may be integrally formed.

The data driver 500 includes the shift register 520, a latch 540, and a digital to analog converter 560.

The shift register 520 outputs a latch pulse to the latch 540.

The latch 540 temporarily stores the data signals DATA2 output from the data arranging part 600 and outputs the data signals DATA2.

The digital to analog converter 560 converts the data signal DATA2, which is a digital signal, to the data voltage, which is an analog signal, using the gamma reference voltage VGREF.

According to an exemplary embodiment of the present disclosure, the data voltages are output in the first output sequence OD1 in the first area RA of the data driver 500 and the data voltages are output in the second output sequence OD1 opposite to the first output sequence OD1 in the second area NA of the data driver 500.

Thus, a user of the display panel 100 would not perceive the image being reversed. The image would still appear to be displayed normally in the atypical display panel 100. In addition, the data voltage of the first side surface SS1 of the atypical display panel 100 is transmitted to the first side surface SS1 through the active area so that the data transmitting line area DTL that would otherwise transmit the data voltage to the first side surface SS1 may be omitted. Thus, the dead space of the display panel 100 may be reduced.

Figure 8:
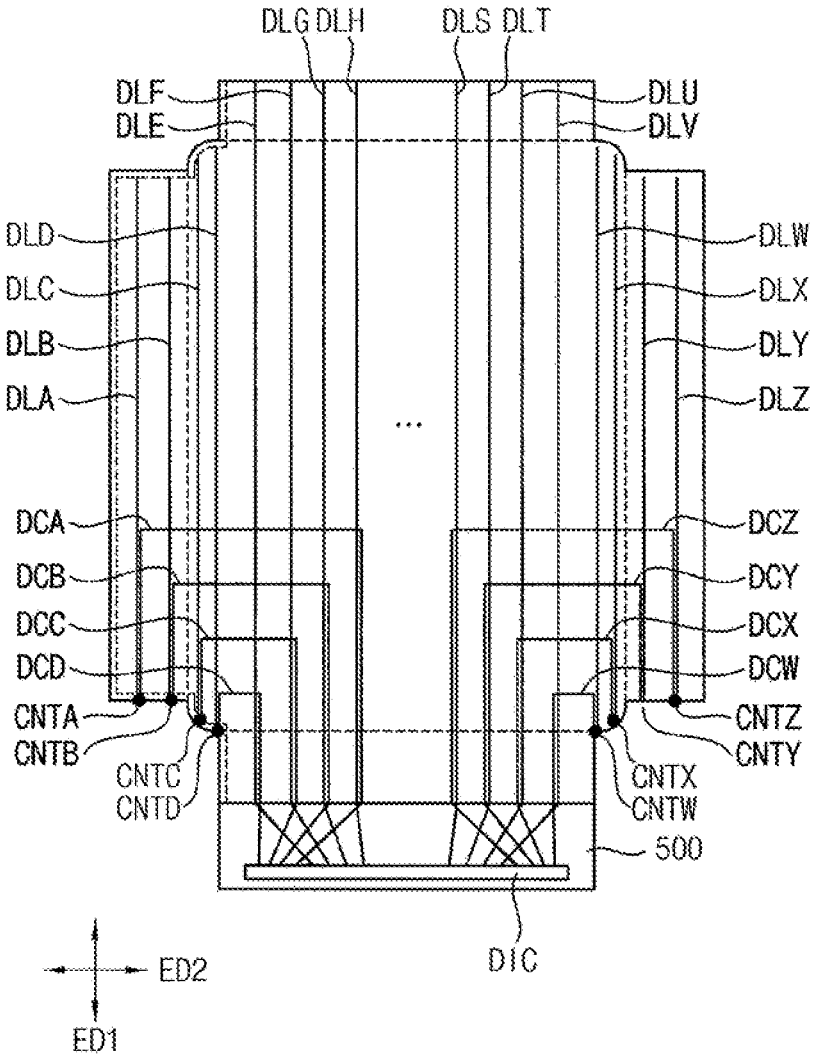
FIG. 8 is a conceptual diagram illustrating a method of driving data lines of a display panel of a display apparatus according to an exemplary embodiment of the present inventive concept.
Figure 9:
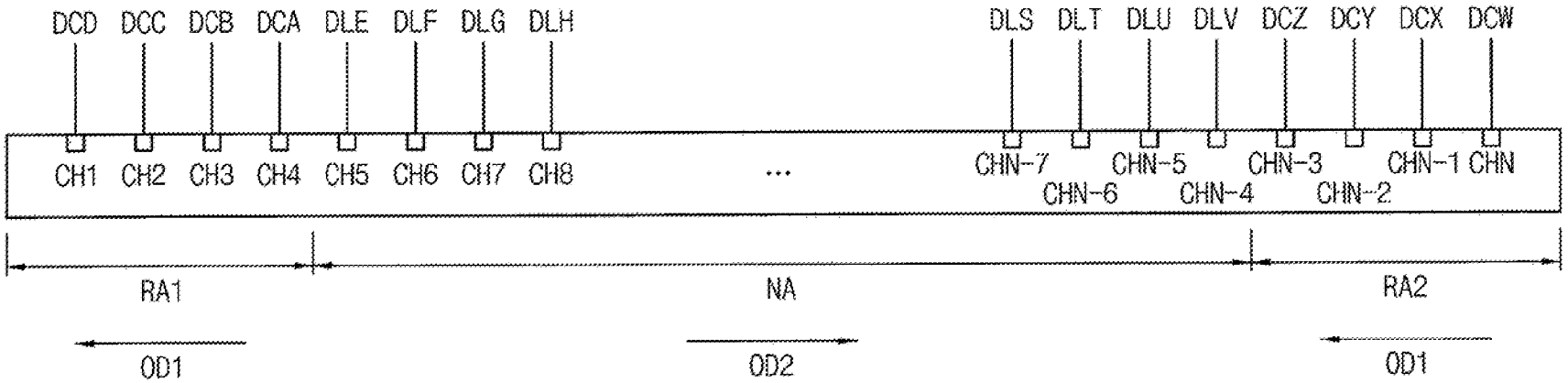
FIG. 9 is a conceptual diagram illustrating a data driver of FIG. 8.

FIG. 8 is a conceptual diagram illustrating a method of driving data lines of a display panel of a display apparatus according to an exemplary embodiment of the present inventive concept. FIG. 9 is a conceptual diagram illustrating a data driver of FIG. 8.

The display apparatus and the method of driving the display panel, according to an exemplary embodiment of the present disclosure, is substantially the same as the display apparatus and the method of driving the display panel described above with referring to FIGS. 1 to 7 except that the reverse driving is applied to both sides of the display panel 100. Thus, the same reference numerals will be used to refer to the same or like parts as those described above with reference to FIGS. 1 to 7 and to the extent that a detailed description of one or more elements is omitted, it may be assumed that the omitted details are at least similar to those of the corresponding element(s) that have already been described.

Referring to FIGS. 1 to 4 and 7 to 9, the display apparatus includes a display panel 100 and a display panel driver. The display panel driver includes a driving controller 200, a gate driver 300, a gamma reference voltage generator 400 and a data driver 500.

The display panel 100 may include an upper surface PS, a first side surface SS1 extending externally from a first side S1 of the upper surface PS, a second side surface SS2 extending externally from a second side S2 of the upper surface PS, and a third side surface SS3 extending externally from a third side S3 of the upper surface PS connecting the first side S1 and the second side S2. The display panel 100 may further include a fourth side surface SS4 extending externally from the fourth side S4 of the upper surface PS facing the third side S3.

The upper surface PS of the display panel 100 may further include a first curved side CS1 connecting the first side S1 and the third side S3, a second curved side CS2 connecting the third side S3 and the second side S2, a third curved side CS3 connecting the second side S2 and the fourth side S4, and a fourth curved side CS4 connecting the fourth side S4 and the first side S1.

In FIG. 8, a first data line DLA and a second data line DLB are disposed in the first side surface SS1, a third data line DLC and a fourth data line DLD are disposed between the first curved side CS1 and the fourth curved side CS4 of the upper surface PS, fifth to twelfth data lines DLE, DLF, DLG, DLH, . . . , DLS, DLT, DLU and DLV are disposed between the third side S3 and the fourth side S4 of the upper surface PS, a thirteenth data line DLW and a fourteenth data line DLX are disposed between the second curved side CS2 and the third curved side CS3 of the upper surface PS, and a fifteenth data line DLY and a sixteenth data line DLZ are disposed in the second side surface SS2.

The fifth to twelfth data lines DLE, DLF, DLG, DLH, . . . , DLS, DLT, DLU, and DLV may extend to the third side surface SS3 and the fourth side surface SS4. The first to sixteenth data lines DLA to DLH, . . . , DLS to DLZ may extend along a first extending direction ED1.

Although sixteen data lines are illustrated in FIG. 8 for convenience of explanation, the display panel 100 may include more than sixteen data lines.

To omit the data transmitting line area DTL of the area A of FIG. 4, the display panel 100 may include first to fourth connecting lines DCA to DCD connecting the first to fourth data lines DLA to DLD to channels of the data driver 500.

To omit the data transmitting line area DTL of an area opposite to the area A of FIG. 4, the display panel 100 may further include fifth to eighth connecting lines DCW to DCZ connecting the thirteenth to sixteenth data lines DLA to DLD to channels of the data driver 500.

The first data line DLA in the first side surface SS1 is connected to a corresponding channel of the data driver 500 through the first connecting line DCA. The first connecting line DCA crosses other data lines (e.g. DLH, DLG, DLF, DLE, DLD, DLC, and DLB) so that the first data line DLA and the first connecting line DCA may be disposed on different planes. The first data line DLA and the first connecting line DCA may be connected to each other through a first contact hole CNTA.

The first connecting line DCA may include a first connecting portion extending in the first extending direction ED1 and connected to the channel, a second connecting portion extending in a second extending direction ED2 crossing the first extending direction ED1 and a third connecting portion extending in the first extending direction ED1 and overlapped with the first contact hole CNTA.

The sixteenth data line DLZ in the second side surface SS2 is connected to a corresponding channel of the data driver 500 through the eighth connecting line DCZ. The eighth connecting line DCZ crosses other data lines (e.g. DLS, DLT, DLU, DLV, DLW, DLX, and DLY) so that the sixteenth data line DLZ and the eighth connecting line DCZ may be disposed on different planes. The sixteenth data line DLZ and the eighth connecting line DCZ may be connected to each other through an eighth contact hole CNTZ.

The first connecting line DCA may include a first connecting portion extending in the first extending direction ED1 and connected to the channel, a second connecting portion extending in a second extending direction ED2 crossing the first extending direction ED1 and a third connecting portion extending in the first extending direction ED1 and overlapped with the first contact hole CNTA.

Similarly, the fifteenth data line DLY in the second side surface SS2 may be connected to a corresponding channel of the data driver 500 through the seventh connecting line DCY and a seventh contact hole CNTY.

Similarly, the fourteenth data line DLX between the second curved side CS2 and the third curved side CS3 of the upper surface PS may be connected to a corresponding channel of the data driver 500 through the sixth connecting line DCX and a sixth contact hole CNTX.

Similarly, the thirteenth data line DLW between the second curved side CS2 and the third curved side CS3 of the upper surface PS may be connected to a corresponding channel of the data driver 500 through the fifth connecting line DCW and a fifth contact hole CNTW.

The data driver 500 may include a first area RA1, a second area NA, and a third area RA2. The first area RA1 includes a first channel group CH1 to CH4 configured to output data voltages in a first output sequence OD1. The second area NA includes a second channel group CH5 to CH8, and CHN-7 to CHN-4 configured to output data voltages in a second output sequence OD2 opposite to the first output sequence OD1. The third area RA2 includes a third channel group CHN-3 to CHN configured to output data voltages in the first output sequence OD1.

The first area RA1 and the third area RA2 are reverse areas outputting the data voltages corresponding to reversed images in a horizontal direction with respect to the input image data. The second area NA is a normal area outputting the data voltage corresponding to the input image data. The first area RA1 may be formed at a first end portion of the data driver 500. The third area RA3 may be adjacent to the second area NA. The third area RA3 may be formed at a second end portion of the data driver 500 opposite to the first end portion of the data driver 500.

According to an exemplary embodiment of the present disclosure, the reverse driving method is applied to both the first side surface SS1 and the second side surface SS2.

The display apparatus may further include the data arranging part 600 to reverse the output sequence of the first area RA1 and the third area RA2.

According to exemplary embodiments of the present disclosure, the data voltages are output in the first output sequence OD1 in the first area RA1 and the third area RA2 of the data driver 500 and the data voltages are output in the second output sequence OD1 opposite to the first output sequence OD1 in the second area NA of the data driver 500.

Thus, the image of the display panel 100 might not be shown as reversed to a user and the image of the display panel 100 may be normally displayed in the atypical display panel 100. In addition, the data voltages of the first side surface SS1 and the second side surface SS2 of the atypical display panel 100 are transmitted to the first side surface SS1 and the second side surface SS2 through the active area so that the data transmitting line areas DTL which are otherwise used to transmit the data voltages to the first side surface SS1 and the second side surface SS2 may be omitted. Thus, the dead space of the display panel 100 may be reduced.

According to exemplary embodiments of the present disclosure, the output sequence of the data voltage is adjusted so that the atypical display panel may output the normal image to the display panel and the dead space of the display panel may be reduced.

Exemplary embodiments described herein are illustrative, and many variations can be introduced without departing from the spirit of the disclosure or from the scope of the appended claims. For example, elements and/or features of different exemplary embodiments may be combined with each other and/or substituted for each other within the scope of this disclosure and appended claims.

What is claimed is:

1. A data driver, comprising:

a first channel group configured to output first data voltages in a first output sequence; and a second channel group of the same data driver configured to output second data voltages in a second output sequence opposite to the first output sequence, wherein the first output sequence provides image data from channel-to-channel, within the first channel group, in a first physical direction on the data driver and the second output sequence provides image data from channel-to-channel, within the second channel group, in a second physical direction on the data driver that is opposite to the first physical direction.

2. The data driver of claim 1, wherein the first channel group is disposed in a first area, and wherein the second channel group is disposed in a second area connected to the first area.

3. The data driver of claim 2, wherein the first area is formed at a first end portion of the data driver.

4. The data driver of claim 2, further comprising a third area including a third channel group configured to output third data voltages in the first output sequence, and wherein the third area is adjacent to the second area.

5. The data driver of claim 4, wherein the first area is formed at a first end portion of the data driver, and wherein the third area is formed at a second end portion of the data driver opposite to the first end portion of the data driver.

6. A display apparatus, comprising:

a display panel configured to display an image;

a gate driver configured to output a plurality of gate signals to the display panel; and a data driver comprising a first channel group configured to output first data voltages in a first output sequence and a second channel group of the same data driver configured to output second data voltages in a second output sequence opposite to the first output sequence, wherein the first output sequence provides image data from channel-to-channel, within the first channel group, in a first physical direction on the data driver and the second output sequence provides image data from channel-to-channel, within the second channel group, in a second physical direction on the data driver that is opposite to the first physical direction.

7. The display apparatus of claim 6, wherein the display panel comprises:

an upper surface;

a first side surface extending from a first side of the upper surface;

a second side surface extending from a second side of the upper surface, the second side of the upper surface facing the first side of the upper surface; and a third side surface extending from a third side of the upper surface, the third side surface connecting the first side of the upper surface and the second side of the upper surface, and wherein the upper surface, the first side surface, the second side surface, and the third side surface are each configured to display the image.

8. The display apparatus of claim 7, wherein the first channel group is configured to output the first data voltages to the first side surface.

9. The display apparatus of claim 8, wherein the display panel further comprises a first data line extending in a first extending direction in the first side surface and a first connecting line connecting a first channel of the first channel group to the first data line.

10. The display apparatus of claim 9, wherein the first data line and the first connecting line are disposed on different planes.

11. The display apparatus of claim 9, wherein the first connecting line comprises:

a first connecting portion extending in the first extending direction and connected to the first channel of the first channel group;

a second connecting portion extending from the first connecting portion in a second extending direction crossing the first extending direction; and a third connecting portion extending from the second connecting portion in the first extending direction.

12. A display apparatus, comprising:

a display panel comprising a first display area and a second display area, with the first display area preceding the second display area in a first direction, the display panel comprising a first data line and a second data line in the first display area, the first data line preceding the second data line in the first direction, the display panel comprising a third data line and a fourth data line in the second display area, the third data line preceding the fourth data line in the first direction, a data driver comprising a first channel and a second channel, with the first channel preceding the second channel in the first direction, and a third channel and a fourth, with the third channel preceding the fourth channel in the first direction, wherein the first data line and the second data line are connected to pixels in the first display area, wherein the third data line and the fourth data line are connected to pixels in the second display area, wherein the first data line is electrically connected to the second channel, wherein the second data line is electrically connected to the first channel, wherein the third data line is electrically connected to the third channel, and wherein the fourth data line is electrically connected to the fourth channel.

13. The display apparatus of claim 12, wherein the display panel further comprises a first connecting line connecting the first data line and the second channel, wherein at least a portion of the first connecting line is disposed in the first display area or the second display area.

14. The display apparatus of claim 13, wherein at least a first portion of the first connecting line is disposed in the first display area, and wherein at least a second portion of the first connecting line is disposed in the second display area.

15. The display apparatus of claim 14, wherein the first connecting line comprises:

a first connecting portion extending in a first extending direction and connected to the second channel;

a second connecting portion extending from the first connecting portion in a second extending direction crossing the first extending direction; and a third connecting portion extending from the second connecting portion in the first extending direction.

16. The display apparatus of claim 12, wherein the display panel further comprises a second connecting line connecting the second data line and the first channel, wherein at least a portion of the second connecting line is disposed in the first display area or the second display area.

17. The display apparatus of claim 12, wherein the display panel further comprises a first connecting line connecting the first data line and the second channel and a second connecting line connecting the second data line and the first channel, and wherein at least one of the first connecting line and the second connecting line crosses at least one of the third data line and the fourth data line in the first display area or the second display area.

18. The display apparatus of claim 12, wherein the first channel, the second channel, the third channel and the fourth channel are sequentially disposed in the first direction.

19. The display apparatus of claim 12, wherein the first display area is a first side surface and the second display area is an upper surface connected to the first side surface, wherein the first display area is curved with respect to the second display area.

20. The display apparatus of claim 12, wherein the display panel further comprises a third display area, the second display area being disposed between the first display area and the third display area, wherein the display panel further comprises a fifth data line and a sixth data line, the first to sixth data lines being disposed in the first direction, wherein the data driver further comprises a fifth channel and a sixth channel, the first to sixth channel being disposed in the first direction.

21. The display apparatus of claim 20, wherein the fifth data line and the sixth data line are connected to pixels in the third display area, and wherein the fifth data line is electrically connected to the sixth channel, and wherein the sixth data line is electrically connected to the sixth channel.

22. The display apparatus of claim 20, wherein the first display area is a first side surface, the second display area is an upper surface connected to the first side surface and the third display area is a second side surface connected to the upper surface, wherein the third display area is curved with respect to the second display area.

* * * * *